US006976915B2

(12) United States Patent
Baker et al.

(10) Patent No.: US 6,976,915 B2
(45) Date of Patent: Dec. 20, 2005

(54) GAMING DEVICE DISPLAY WITH SIMULATED HALFTONES

(75) Inventors: Curtis L. Baker, Sparks, NV (US); Michael D. Callahan, Sparks, NV (US); Jeffery J. Jo, Reno, NV (US); Gene A. Spoor, Wadsworth, NV (US)

(73) Assignee: IGT, Reno, NV (US)

( * ) Notice: Subject to any disclaimer, the term of this patent is extended or adjusted under 35 U.S.C. 154(b) by 29 days.

(21) Appl. No.: 10/243,898

(22) Filed: Sep. 13, 2002

(65) Prior Publication Data

US 2004/0021705 A1 Feb. 5, 2004

Related U.S. Application Data

(63) Continuation-in-part of application No. 10/210,516, filed on Jul. 31, 2002.

(51) Int. Cl.[7] ..... G09F 13/08; G09F 13/04

(52) U.S. Cl. ..... 463/1; 463/20; 40/564; 40/577

(58) Field of Search ..... 40/541, 546, 564, 40/570, 572, 577, 582, 583; 463/1, 20

(56) References Cited

U.S. PATENT DOCUMENTS

| | | | | |
|---|---|---|---|---|
| 2,114,711 A | | 4/1938 | Horinstein | 40/219 |
| 2,372,124 A | | 3/1945 | Schenkel | 40/577 |
| 4,326,351 A | | 4/1982 | Heywood et al. | 40/467 |
| 4,337,590 A | | 7/1982 | Jackson | 40/615 |
| 4,391,853 A | | 7/1983 | Pointon | 427/152 |
| 4,682,709 A | | 7/1987 | Brandes et al. | 221/2 |
| 4,995,185 A | * | 2/1991 | Cheng | 40/582 |
| 5,352,532 A | | 10/1994 | Kline | 428/447 |
| 5,442,461 A | | 8/1995 | Levien | 358/3.19 |
| 5,505,801 A | | 4/1996 | Harris | 156/100 |
| 5,625,968 A | * | 5/1997 | Ashall | 40/546 |
| 5,897,735 A | | 4/1999 | Peskin | 156/230 |
| 5,927,191 A | | 7/1999 | Wheatley, Jr. et al. | 101/128.4 |
| 6,027,115 A | | 2/2000 | Griswold et al. | 273/143 R |
| 6,038,977 A | | 3/2000 | Haney et al. | 101/490 |
| 6,217,186 B1 | * | 4/2001 | Fisher | 362/31 |
| 6,244,183 B1 | | 6/2001 | Haney et al. | 101/490 |
| 6,308,444 B1 | * | 10/2001 | Ki | 40/546 |

(Continued)

FOREIGN PATENT DOCUMENTS

EP 0896308 10/1999

(Continued)

OTHER PUBLICATIONS

Machine translation of JP 08328492 to Kimura et al. from Japanese Patent Office website.*

(Continued)

*Primary Examiner*—Daniel J. Colilla
(74) *Attorney, Agent, or Firm*—Bell, Boyd & Lloyd, LLC

(57) ABSTRACT

A panel or reel strip of a gaming device that includes halftones. The panel or reel strip includes a medium and a photographically created multicolor image on one side of the medium. A silkscreen ink layer is provided on the other side of the medium. The ink defining at least one halftone producing hole array. The multicolor image and the hole array are both computer created and downloaded to a photo imager. The photo image of the hole array is used to create a screen that produces a wash layer of ink on the back of the colored image. The wash layer defines selectively made hole arrays that enable a desired amount of light to shine through the colored image, providing a glow effect.

36 Claims, 7 Drawing Sheets

U.S. PATENT DOCUMENTS

| | | | | |
|---|---|---|---|---|
| 6,368,758 | B1 | 4/2002 | Camp et al. | 430/12 |
| 6,606,168 | B1 * | 8/2003 | Rylander | 358/3.09 |

FOREIGN PATENT DOCUMENTS

| | | | | |
|---|---|---|---|---|
| GB | 2 218 561 A | | 11/1989 | |
| GB | 2 239 547 A | | 7/1991 | |
| GB | 2 306 746 A | | 5/1997 | |
| GB | 2 358 513 A | | 7/2001 | |
| JP | 08328492 A | * | 12/1996 | G09F 13/04 |
| JP | 2001034210 A | * | 2/2001 | G09F 13/18 |
| WO | WO 9842518 | | 1/1998 | |
| WO | WO 0067049 | | 9/2000 | |
| WO | WO 0217282 A1 | * | 2/2002 | G09F 13/18 |

OTHER PUBLICATIONS

Kodak Professional Duraclear Display Material (website) written by www.kodak.com, printed Oct. 12, 2001.

* cited by examiner

GAMING DEVICE DISPLAY WITH SIMULATED HALFTONES

PRIORITY CLAIM

The present invention is a continuation-in-part of U.S. patent application Ser. No. 10/210,516, filed Jul. 31, 2002, entitled "GAMING DEVICE DISPLAY HAVING A DIGITAL IMAGE AND SILKSCREEN COLORS AND PROCESS FOR MAKING SAME".

CROSS-REFERENCE TO RELATED APPLICATION

This application is related to the following commonly-owned co-pending patent applications: "GAMING DEVICE DISPLAY HAVING A DIGITAL IMAGE AND SILKSCREEN COLORS AND PROCESS FOR MAKING SAME," Ser. No. 10/210,516.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates to gaming devices. More particularly, the present invention relates to gaming device displays, such as the top or bottom glass above and below, respectively, the reels of a slot machine.

Gaming device manufacturers provide gaming machines such as slot machines employing a plurality of reels which each have a plurality of symbols. In these gaming machines, the player spins the reels, which produce a random generation of a combination of symbols. If the generated combination or a portion of the combination matches one of a number of predetermined award producing or winning combinations, the player receives an award. The award is commonly one or more credits that the player can play or redeem for money.

Gaming device manufacturers also provide video poker games that generate credits for the player. The player can either use the awarded credits to play more poker hands or redeem the credits for money. These examples as well as many other types of gaming machines award credits to the player.

To increase player enjoyment and excitement, and to increase the popularity of the gaming machines, gaming device manufacturers constantly strive to make their gaming devices as fun, exciting and attractive as possible. Certain manufacturers go to great lengths in creating artwork that provides a distinct look and feel to each gaming machine and that also conveys a theme for the machine. When a player is deciding which machine to play, the player may pick the one that "looks" like the most fun or looks the most attractive.

Gaming device artwork has historically has been made using conventional silk-screening, which as discussed herein, is limited by the amount of colors available and the complexity of the design. With these limitations in mind, a silkscreen process begins with the designer who creates a design using a computer. A raster image processor ("RIP device") is used to convert the computer digital images to a raster image, which is the form needed for the next step in the process. Using an image setting service, such as an Agfa Film Imagesetter, the rasterized image is transferred to a large piece of film.

The image setting device outputs the image onto the film as rows upon rows of dots which are mathematically spaced apart. With conventional silk-screening, every color requires a separate film negative or positive (known as a plate) output from the image setting device. The plates are each exposed to ultraviolet light using a time and labor intensive process of temporarily adhering these negatives or positives to a stretched screen material. The stretched screen material has on one side a layer of emulsion. The ultraviolet light is applied for a predetermined time to the film and screen material, exposing the image of the film onto the screen material. The rows of dots produced by the image setter block the ultraviolet light from exposing the emulsion of the screen material that lies directly behind the dots.

After exposing the emulsion layer of the selected areas of the screen material, the exposed screen material is washed to remove the remaining areas of emulsion. The washed screens are then taken to a printing station and used to apply ink to the display glass, which is mounted in the cabinet of the gaming device in a conventional manner. A separate film and a separate screen are therefore required for each color the designer uses. The screens are sequentially placed over the glass, wherein an ink of a desired color is wiped over the screen and onto the glass. After each ink application, the glass is cured. This process is repeated until each color is applied. Typically, a white plate is applied last over the other colors to make them appear more opaque and vibrant.

With gaming device displays becoming more complex, requiring more colors, traditional silk-screening has proven to be too time consuming and labor intensive to remain a viable option. While producing a high quality display, traditional silk-screening cannot meet increasing demand and decreasing lead times.

To overcome the deficiencies of conventional silk-screening, manufacturers have explored the use of digital printers. One digital printer used by the assignee of the present invention is a Durst Lambda™ printer. The digital printer eliminates many of the processing steps required in conventional silk-screening. With the digital printer, the designer still creates a computer image, which is rasterized and placed in the proper form for the digital printer. Instead of outputting a separate film for each color, however, the digital printer outputs a single piece of film, containing all of the colors and art that make up a design. The film can be a transparent or translucent film, such as DuraClear, DuraTrans or Day/Night. The digital printer images the design onto the film using lasers, wherein the laser exposed media is developed using traditional film processing, such as a known RA-4 process.

However, digital printing has certain limitations. All known digital printers, including the Durst Lambda™ printer, print a continuous tone rather than creating rows upon rows of mathematically spaced apart dots produced during conventional screen printing. In certain instances, as discussed below, it is desirable to have the dots instead of a continuous layer. A need exists to overcome this shortcoming of the digital printer with respect to manufacturing displays and particularly glass displays for gaming devices.

SUMMARY OF THE INVENTION

The present invention includes a panel, reel strip or other display, herein referred to collectively as a "display", of a gaming device having halftones.

The display with halftones selectively enables light to shine therethrough and enables the intensity of the light to be varied. The present invention also provides an efficient and productive method for developing and producing the panel (and preferably the glass panel), reel strip or other display, which provides a bright and rich color quality. In one embodiment of the present invention, a transparent medium has a digital image produced on one side and has a layer of silk-screened ink placed on the opposite side. The non-inked areas enable back-lighting to make matching colors of the digital image appear to glow (i.e., let a relatively high or great amount of light pass through). The inked areas prevent less backlight from shining through from the back of the glass and allow more outside light to reflect off the matching colors of the digital image, brightening such colors and making them appear rich or full of color.

The process to produce the panel, reel strip or display is efficient, flexible, repeatable and is less costly than typical silk-screening processes that require multiple stencils or screens and multiple ink printing sessions and cure periods. The process often only requires one layer of silk-screen ink, which in one embodiment is white to enable some light to pass through the matching colors of the digital image. For certain designs, the present invention may require more than one layer of ink, but less than the layers required for completely silk-screening the same designs. The layer of white ink makes portions of the transparent medium translucent. Other portions of the transparent medium are left unblocked, where the designer wishes the panel or reel strip to glow. The designer can alternatively silk-screen darker and darker or even black ink, or combinations thereof, to make the digital image colors appear more and more opaque.

In another embodiment, a plurality of silk-screen layers are applied, which selectively make portions of the panel, reel strip or display opaque or translucent. Here, a white silk-screen layer is applied to a reverse side of the transparent medium from the digital image. The white layer makes the transparent medium translucent. A dark or black layer of ink is selectively silk-screened onto the white ink layer, making those areas opaque. In this embodiment, the entire panel, reel strip or display appears rich and bright due to the initial layer of white ink.

The portions of the white silk-screened side of the medium that are not additionally silk-screened with dark colors enable some backlighting to shine through and cause selected symbols or indicia to be highlighted relative to the opaque colors. The portions of the white silk-screen side of the medium that do have additional silk-screened layers appear even fuller or richer. In this alternative arrangement, certain areas of the medium can be left transparent to further highlight selected areas. It should be appreciated that the two or three silk-screened layers of this embodiment still provide a substantial reduction in time, cost and energy from silk-screening multiple colors as is presently known.

Each of the above embodiments preferably includes a protective coating, which protects the silk-screened ink from environmental hazards and from damage due to handling. Also, each of the above embodiments can include a layer of adhesive or other substance for enabling the medium to adhere or attach to a panel or substrate, such as a piece of glass or plastic.

As discussed above, the digital images typically have continuous tones and are not made in rows of dots, as is the case with the imager for the conventional silk-screening operation. To make a display with halftones, the silk-screen imager would produce arrays of dots that have different dot amplitudes and/or frequencies, which provide for a wide range of variability in terms of the amount of light that shines through a particular color or a particular area of the display. That is, as the percentage of light-blocking dots approaches zero, the digital image color is very shiny, washed out and translucent. As the percentage of light-blocking dots approaches approximately one hundred percent, the digital image color becomes more and more opaque and rich, appearing "full of color". These effects are highly desirable and provide the designer another dimension in designing gaming machine displays, namely, to have control of the amount of backlight that shines through a particular color area from zero to approximately one hundred percent as opposed to having only zero and one hundred percent.

Using the image setter to output white plates and the digital printer to output a color image creates certain problems because the two machines use different technologies. Trying to match the outputs of both machines to create a final end product has been found to require trial and error, produce waste and cause down time. The outputs are difficult to place in registry or match up properly, forcing the operators to scale repeatedly one of the outputs up or down until finding the proper scale factor. This takes a substantial amount of time and effort. Further, when a particular display needs to be produced again at a different time, the entire matching or registry procedure must be repeated.

The present invention includes manipulating the software used to produce the computer designs to produce arrays of dots having varying amplitudes and/or frequencies on a digitally outputted drawing. It is not necessary to rely on the printer to output dot arrays. The drawing itself includes the dot arrays and dictates that the digital printer prints the dots. In one embodiment, the software is used to create a positive image of the white plate including one or more halftone areas, i.e., areas having varying dot frequency or amplitude arrays. In another embodiment, the software is used to create a negative image of the white plate. The positive or negative image is used to produce a positive or negative silk-screen via the process described above. A silk-screen is then placed in registry with the digitally colored medium and white layer of ink is then silk-screened onto the back of the colored medium. Whether the white plate is positive or negative determines which direction or face of the plate or medium is placed in registry with the colored medium.

Performing the silk-screen step does not overly tax or complicate the overall process because only a single white plate needs to be made for light blocking purposes. All the colors of the display are produced on a single digital image. The digital white plate, made from the same drawing as the positive design image and produced using the same machine that produces the positive design image, matches perfectly and repeatably with the plate containing the positive design image. The resulting display includes only three layers in one embodiment, the glass, the digital color image plate and the silk-screened white plate (made from a digital positive or negative) and possibly one or more protective layers.

While in one preferred embodiment a white plate is used for light blocking, the plate with simulated halftones can be made of any color, such as a dark color to make the corresponding color on the opposing side of the medium totally opaque. It is also contemplated that multiple different colored ink layers could be placed on the digital multicolored medium. In an alternative embodiment, a separate medium can be made having a photographically imaged white layer with simulated halftones, wherein the white medium and the colored medium are laminated together in registry to produce an overall color display with halftones. It may also be possible with an advanced photographic material to photographically produce an image on both sides of the medium, wherein one side includes multiple colors and the other side includes white areas with simulated halftone dots.

The method of the present invention produces a high quality display that is repeatable and can be archived. The design is stored on a computer hard drive, diskette, CD-rom, tape backup or other suitable type of computer readable memory. The design can therefore be recalled at any time, wherein any suitable desired number of additional displays can be produced.

It is therefore an advantage of the present invention to provide a cost effective gaming device display with halftones.

Another advantage of the present invention is to provide a method for producing a display having halftones that operates with high speed output devices.

A further advantage of the present invention is to provide a method of producing a gaming device display that enhances the creativity of the designer.

Further still, an advantage of the present invention is to provide a method for producing a display having halftones that at least maintains current standards of quality.

Moreover, an advantage of the present invention is to print parts using a single machine and eliminate mismatch problems created by trying to match outputs from different print imaging machines.

Still another advantage of the present invention is to provide a method for producing a display having halftones with minimal downtime and waste.

Still a further advantage of the present invention is to provide a method for producing a display having halftones, wherein the design for same can be archived and readily recalled at a later time to produce any desired additional number of displays.

Additional features and advantages of the present invention are described in, and will be apparent from, the following Detailed Description of the Invention and the figures.

DETAILED DESCRIPTION OF THE INVENTION

Gaming Device and Electronics

Figure 1A:
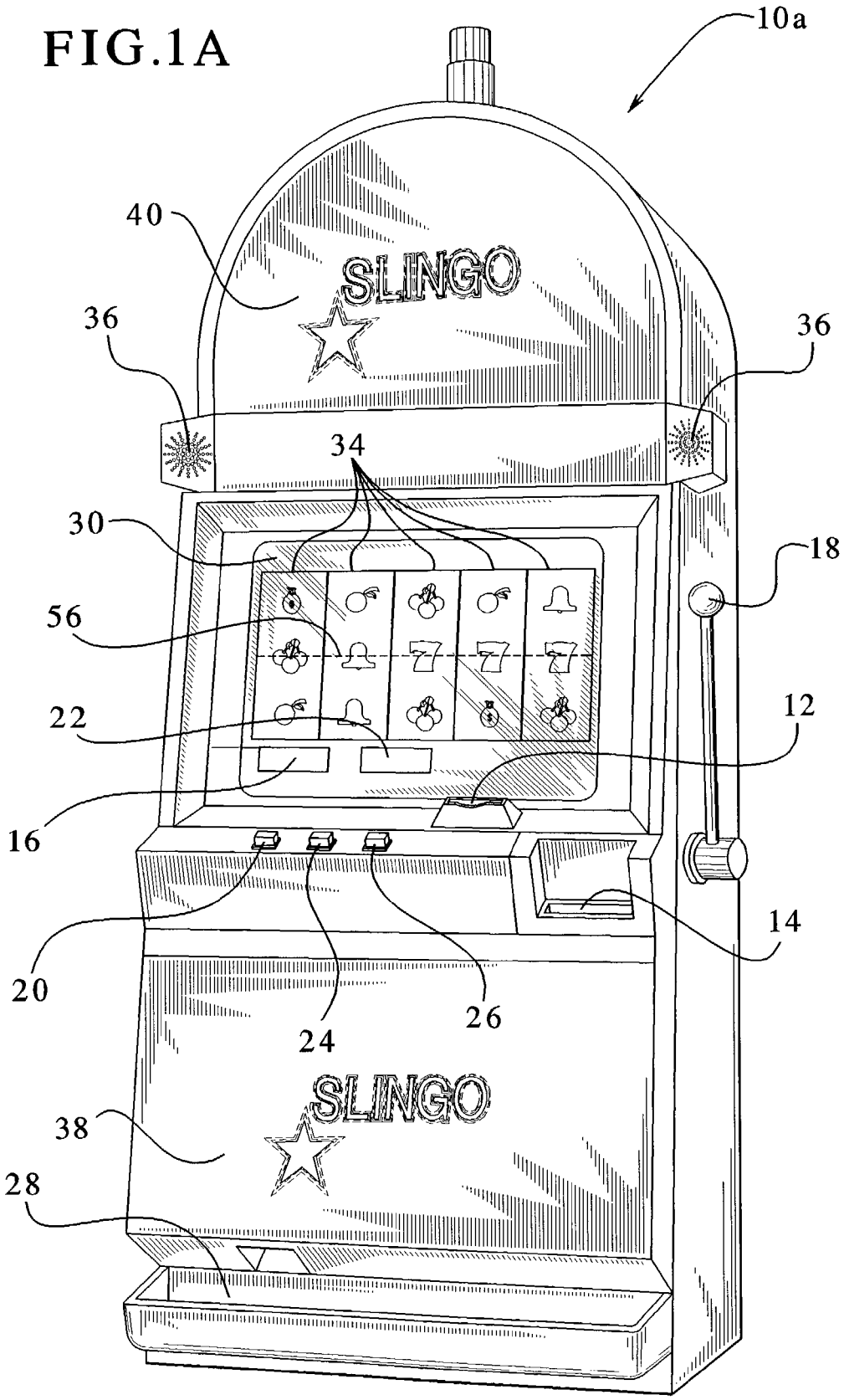
FIGS. 1A and 1B are perspective views illustrating alternative embodiments of the gaming device of the present invention.
Figure 1B:
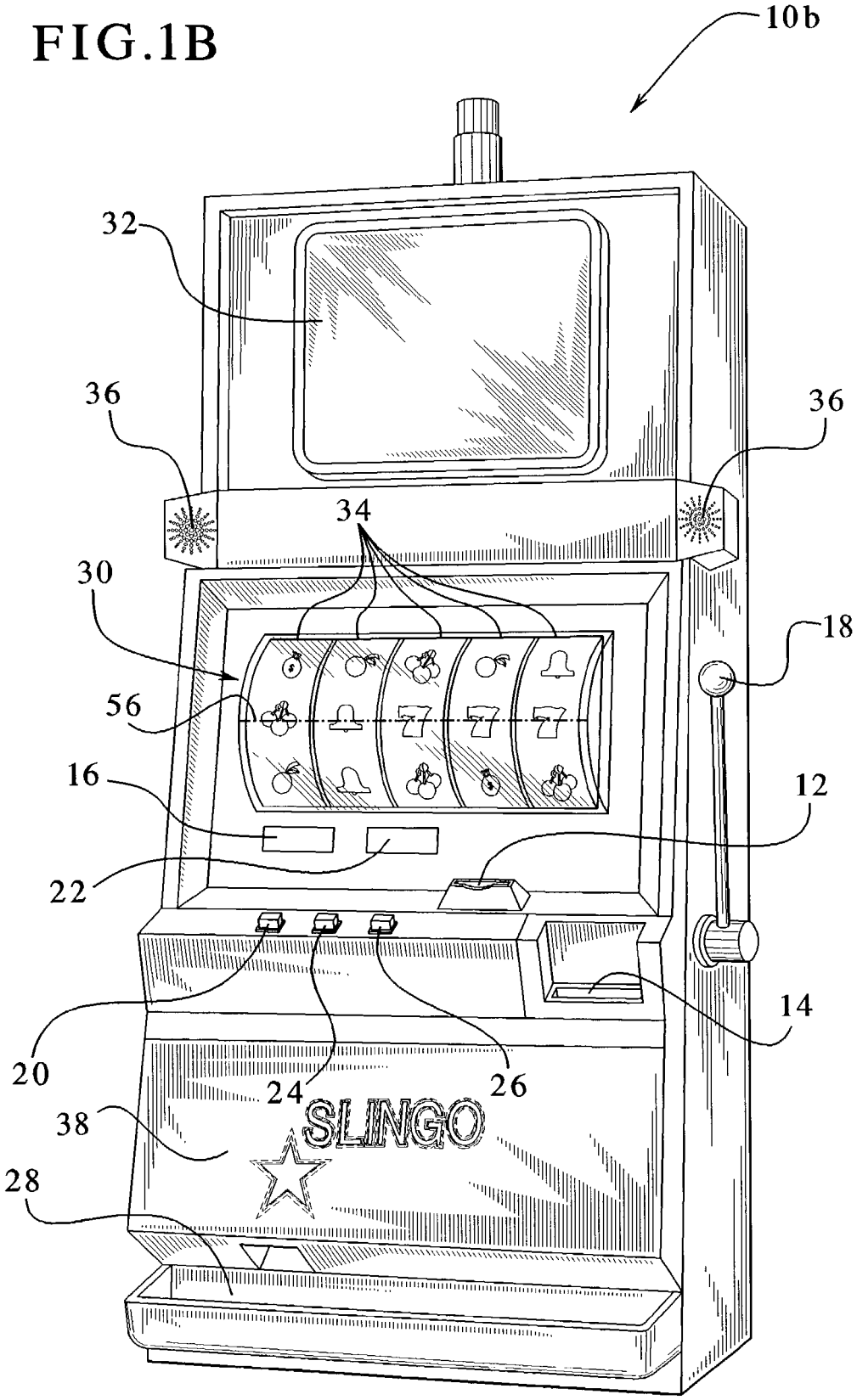

Referring now to the drawings, and in particular to FIGS. 1A and 1B, gaming device 10*a* and gaming device 10*b* illustrate two possible cabinet styles and display arrangements and are collectively referred to herein as gaming device 10. The gaming device of the present invention has the controls, displays and features of a conventional gaming machine. The player may operate the gaming device while standing or sitting. Gaming device 10 also includes slant top style gaming device (not shown), which a player operates while sitting.

The gaming device 10 may include any slot, poker, blackjack, keno, or other base or primary game. The gaming device 10 may also include any secondary or bonus triggering events, bonus or secondary games as well as any progressive game coordinating with these base or bonus games. The symbols and indicia used for any of the base, bonus and progressive games include mechanical, electronic, electrical or video symbols and indicia.

The gaming device 10 includes monetary input devices. FIGS. 1A and 1B illustrate a coin slot 12 for coins or tokens and/or a payment acceptor 14 for cash money. The payment acceptor 14 may also include other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player begins the game by pulling arm 18 or pushing play button 20.

As shown in FIGS. 1A and 1B, gaming device 10 also includes a bet display 22 and a bet one button 24. The player places a bet by pushing the bet one button 24. The player increases the bet by one credit each time the player pushes the bet one button 24. When the player pushes the bet one button 24, the number of credits shown in the credit display 16 decreases by one, and the number of credits shown in the bet display 22 increases by one. A player may cash out by pushing a cash out button 26 to receive coins or tokens in the coin payout tray 28 or other forms of payment, such as an amount printed on a ticket or credited to a credit card, debit card or smart card.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

If the primary game is a slot game, the slot base game of gaming device 10 preferably displays a plurality of reels 34, such as three to five reels 34 in mechanical or video form on one or more of the display devices. Each reel 34 displays a plurality of indicia such as bells, hearts, fruits, numbers, letters, bars or other images or symbols which preferably correspond to a theme associated with the gaming device 10. If the reels 34 are in video form, the display device displaying the video reels 34 is preferably a video monitor. Each gaming device 10 includes speakers 36 for making sounds or playing music as described below.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10 may also include one or more bonus games that give players the opportunity to win credits. The gaming device 10 may employ a video-based display device 30 or 32 for the bonus games. The bonus games include a program that automatically begins when the player achieves a qualifying condition in the base game.

In FIG. 1A, the reels 34 in an embodiment are simulated and the display device 30 is a video monitor. In certain instances the video display device 30 does not display the reels 34. For example, if a bonus game is triggered, the reel display discontinues and the bonus game display begins. The video display 30 may therefore include a touch screen that enables a player to input decisions into the gaming device 10 by sending a discrete signal based on the area of the touch screen that the player touches or presses. When the bonus game ends, gaming device 10 redisplays the reels 34.

In FIG. 1B, the reels 34 are mechanical and the central display device 30 is a mechanical display device having backlighting and any other features commonly found in connection with mechanical reels. To display a bonus game in combination with the mechanical reels 34 of the FIG. 1B, the upper display device 32 displays the bonus game. In such a case, the display device 32 is in an embodiment a video monitor and may include a touch screen. Here, the upper display device 32 remains blank or displays other indicia until a bonus game is triggered, whereby the video display device 32 displays the bonus game. When the bonus game ends, the upper display device 32 returns to a blank screen or screen having other indicia.

Any exposed area on the cabinet of gaming device 10, especially exposed areas facing the front of the gaming device, which are not consumed by one of the display devices 30 or 32 or the other functional components described above, may include the panels or displays and particularly the glass panels or displays of the present invention. In particular, the lower panel 38 on both the embodiments 10*a* and 10*b* of FIGS. 1A and 1B includes a panel having the halftones of the present invention. In FIG. 1A, one or both the lower panel 38 and an upper panel 40 are panels having the halftones of the present invention.

Figure 2:
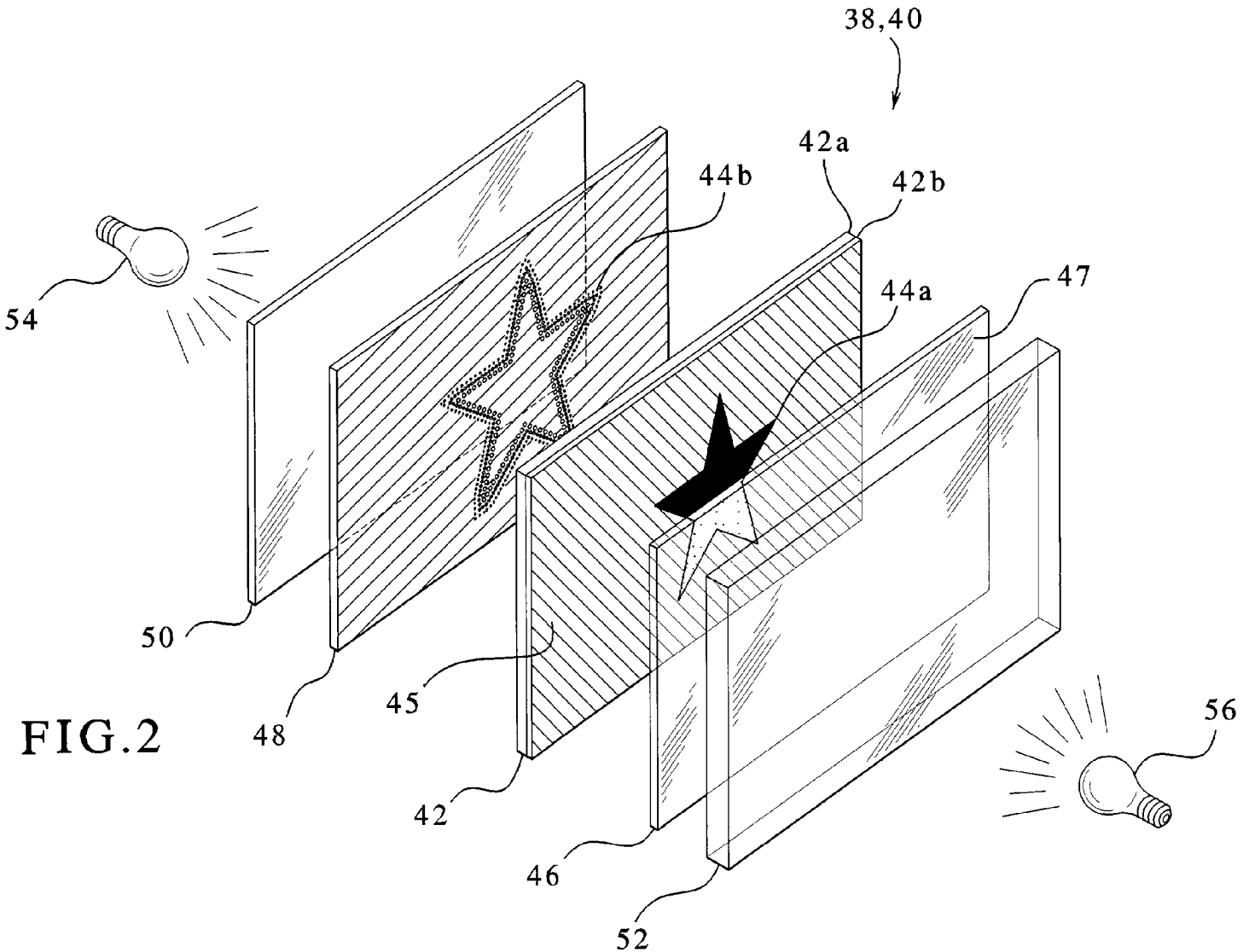
FIG. 2 is an exploded perspective view illustrating an improved panel or display produced having the halftones according to one embodiment of the present invention.

Referring now to FIG. 2, one embodiment of an improved panel or display 38 or 40 having the halftones of the present invention is illustrated. While the panels or displays 38 and 40 are illustrated in FIGS. 1A and 1B as being lower front and upper front panels, respectively, panels or displays 38 and 40 may be disposed in any suitable open location on the gaming device 10. The panel or display 38 or 40 includes a medium 42 having a positive image or indicia 44*a*. In this case, the positive image 44*a* is the star, for example the star associated with the word "SLINGO" in FIGS. 1A and 1B. The positive image or indicia may be any image or indicia including words, objects, symbols, people, characters, structures, scenes, places, etc., and any combination thereof. Positive image 44*a* is produced by a digital imaging device, such as a Durst Lambda™ photographic imager, and therefore may have any number of different colors including flesh tones.

The medium 42 includes any suitable clear film or plastic, which exposes or enables the image 44*a* to be displayed. In a simplified embodiment, the medium 42 can be a clear plastic sheet that is sent through a color printer. The medium 42 in one embodiment is translucent. In a preferred embodiment, however, the medium 42 is transparent, so that a maximum amount of light passes through desired areas of the medium.

In one embodiment, the imaged medium 42 is a DURACLEAR™ display material by KODAK™. The DURACLEAR™ display material has a clear-base color transparency material 42*a,* which is polyester of approximately 7 mils in thickness. The DURACLEAR™ display material has a layer of emulsion 42*b* of approximately 1 mil thickness. The image 44*a* is developed by an RA-4 process known to those of skill in the art. The RA-4 process generally involves the use of specialized chemicals, such as KODAK EKTACOLOR RA™ chemicals. These materials can be processed, for example, in continuous roller transport processors, in trays, rotary tube processors or drum processors.

For the panels 38 and 40, a layer of double sided adhesive 46 is placed on the imaged side 42*b* of the medium 42. The double sided adhesive 46 can be any such adhesive known to those of skill in the art. The double sided adhesive 46 is in one embodiment transparent and has a thickness of approximately three mils. The double sided adhesive 46 in an embodiment has a release liner 47, which is disposed on the opposite side of the adhesive 46 from the medium 42. Release liner 47 enables an operator to handle the double sided adhesive 46 and properly place it over the image 44*a* of the medium 42. It should be appreciated that the adhesive 46 is only necessary when the medium 42 is to be adhered to a substrate, such as the substrate 52.

A silk-screen ink 48 is applied to the back of medium 42. That is, silk-screen ink 48 adheres to the transparency material 42*a* in one preferred embodiment. The silk-screen ink or layer 48 is applied through any suitable method of silk-screening known to those of skill in the art. In a preferred embodiment, the ink 48 is a UV ink that is sent through a UV reactor to be cured.

The silk-screen ink 48 defines a non-inked hole array 44*b* collectively forming a shape similar to and in registry with the border of the colored image 44*a*. The non-inked hole array 44*b* enables a desired and controlled amount of light to shine through the edges or border of the colored star image 44*a*. The non-inked hole array 44*b* produces the halftones of the present invention. The hole array 44*b* can have any desired hole density, from above zero percent open (no or very little light shines through) to 100 percent open (no blockage, all available light shines through). Further, the density of hole array 44*b* can vary creating sub-areas of lesser and higher light, e.g., more or less glow. In the illustrated embodiment, the halftone producing hole array 44*b* is placed in registry with the star 44*a,* which is colored with any desired color or color combination.

In a preferred embodiment, the silk-screen ink 48 around the hole array 44*b* is white and has the effect of blocking and reflecting much of the light from light sources 54 and 56, making the area of the transparent medium 42 that is in registry with the silk-screen ink 48 appear translucent. The light from light source 54 on the other hand passes through the hole array 44*b* in the silk-screen ink 48. The overall effect is that a color 45 of the area of medium 42 that is in registry with the, e.g., white, silk-screen layer 48 appears richer and full of color. The border around image 44*a* on medium 42 appears on the other hand to glow or shine. The image 44*a* is thereby highlighted with respect to the surrounding color 45.

In the above manner, the designer can selectively pick areas of the panel 38 or 40 that are more brightly back lit than other areas of the panel 38 or 40. By starting with a transparent material 42*a,* the white silk-screen layer 48 is selectively applied in the areas that the designer does not wish to be as brightly back lit. These areas however will reflect light from a source 56 outside of the gaming device 10 more readily than will the image 44*a* of the medium 42. The halftone forming hole array 44*b* is used for highlighting and is typically relatively small with respect to the area of the silk-screen ink 48, such as the border around the star or the word "SLINGO" in FIGS. 1A and 1B. If the hole array area 44*b* becomes too large, the panel 38 or 40 may begin too look washed out or dull.

After the ink 48 is cured, a protective layer of laminate 50 is placed on the back of the panel 38 or 40, protecting the layer of silk-screen ink 48 and the hole array 44*b*. The laminate 50 protects the silk-screen ink 48 from being scratched or peeled off and protects the silk-screen ink from environmental exposure and handling damage. Laminate 50 in one embodiment is optically clear polyester of approximately 1.5 mils. The transparent layer 50 enables all light from the light source 54 to pass through the layer.

In one embodiment, the imaged medium 42, the double sided adhesive 46, the silk-screen ink 48 and the laminate 50 are applied to a substrate 52 to produce the panel 38 or 40. The substrate 52 may be any clear glass or plastic known to those of skill in the art. In one embodiment, substrate 52 is 3/16 inch (4.8 millimeters) thick. In a preferred embodiment, the substrate 52 is glass, which may be tempered.

Figure 3:
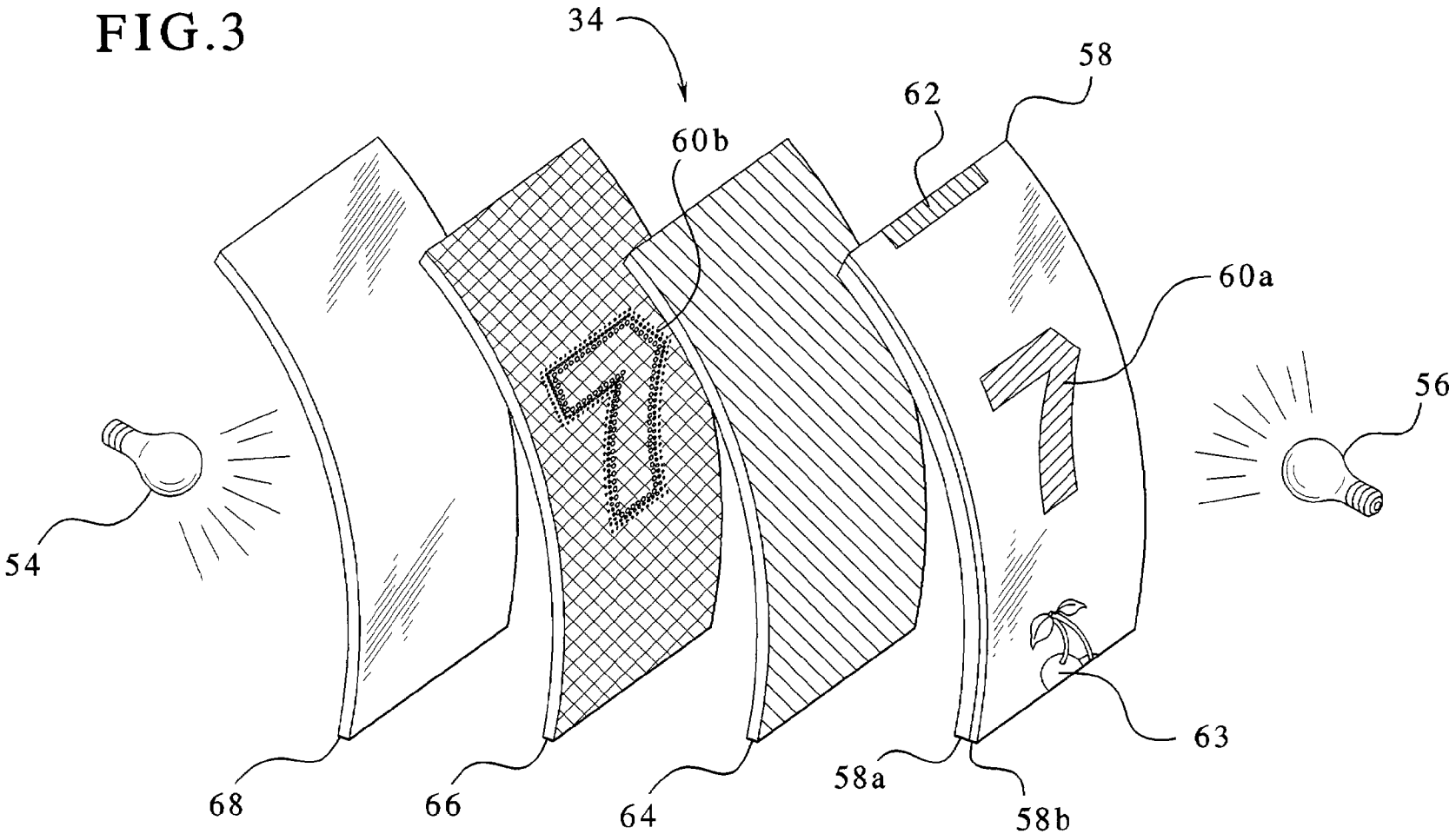
FIG. 3 is an exploded perspective view illustrating an improved reel strip having the halftones of the present invention.

Referring now to FIG. 3, one embodiment of an improved reel or reel strip 34 having the halftones of the present invention is illustrated. The reel strip 34 includes a medium 58 having a positive image 60*a*. In this case, the positive image 60*a* is the letter or symbol "7". The image or indicia 60*a,* which is a symbol of the reel 34, may be any image including words, objects, symbols, people, characters, structures, scenes, places, etc., and any combination thereof. The image 60*a* as above is produced by a digital imaging device, e.g., the Durst Lambda™ printer, and therefore may have any number of different colors including flesh tones.

The medium 58 again includes any clear film or plastic that exposes or enables the image or indicia 60*a* to be displayed. The imaged medium 58 in a preferred embodiment is a DURACLEAR™ material. The DURACLEAR™ material of the reel 34 has a clear-base color transparency material 58*a* which is polyester of approximately 7 mils in thickness. The DURACLEAR™ material also has the emulsion layer 58*b* of approximately one mil thickness. In a preferred embodiment, the medium 58 is transparent, however, in an alternative embodiment the medium 58 is translucent. The image 60*a* is in one embodiment developed by the RA-4 process known to those of skill in the art.

For reference, a portion of separate symbols 62 and 63 are illustrated. The symbol 62 resides above the image 60*a*. The symbol 63 resides below the image 60*a*. Both the symbol 62 and the symbol 63 are produced through the RA-4 process described above.

Since the medium 58 is not mounted to a substrate, such as the substrate 52 of FIG. 2, the double sided adhesive layer 46 of FIG. 2 is not necessary. Instead, the medium 58 receives two silk-screen ink layers 64 and 66. In the art of silk-screening, it is well known to apply a plurality of different colors using various screens, wherein one screen is used for each different color. Typically, a first color is applied and cured before a second color is applied, and so on. Each color is produced via silk-screen, which is made via a medium outputted by the digital imaging device. These mediums are referred to as "plates". A separate plate is needed for each color of a silk-screen operation. In the illustrated embodiment, two plates are needed, one for each layer 64 and 66. In the embodiments described in connection with FIG. 2, only a single "white plate" for silk-screening is needed.

In FIG. 3, a first layer of silk-screen ink 64 adheres to the back of the transparency material 58*a* of the medium 58. The silk-screen ink 64 is UV ink that is cured in a UV reactor in one embodiment. The UV ink of layer 64 is white in one preferred embodiment. The white layer enables light emanating from light source 56 outside of the gaming device 10 to more readily reflect off of the colors of the symbol 60*a* and the symbols 62 and 63. That is, the symbols appear more rich and full of color after the white silk-screen layer 64 is applied to the back of the medium 58.

The second silk-screen layer 66 is adhered to and resides on the first silk-screen layer 64 except in areas where the designer wishes backlight from a light source 54 behind the reel 34 to shine diffusely through to the front of the gaming device 10. In this instance, the designer wishes the backlight 54 to shine diffusely through and highlight the boundary and border of the lucky 7 image 60*a* of the reel 58. The silk-screen ink 66 does not therefore flow into the hole array 60*b,* collectively bordering the number 7. In one embodiment, the second silk-screen layer 66 is black UV ink, which absorbs all or virtually all of the backlight from source 54. Other dark colors, such as dark blue, would also serve the purpose of absorbing most of the backlight 54. The hole pattern creates portions of the border of the lucky 7 image 60*a* that are varyingly translucent. These portions highlight lucky 7 with respect to the other symbols 62 and 64 of the reel strip 34, which are totally opaque or almost totally opaque.

In alternative embodiments, a portion of the silk-screen ink layer 64 includes one or more hole arrays, so that a portion of the reel 34 remains transparent, further highlighting selected areas. Alternatively, the embodiment of FIG. 3 can be produced using a translucent medium, such as DURATRANS™ Day/Night media by KODAK, instead of a transparent medium. Here, only a single dark or black silk-screened ink is selectively applied to produce the translucent and non-translucent image. Further alternatively, a panel 38 or 40 (instead of a reel) can be made according to the dual inking process disclosed in connection with FIG. 3, and a reel 34 can be made according the single inking process disclosed in connection with FIG. 2.

As with the panel 38 or 40 of FIG. 2, the silk-screen layers 64 and 66 of the reel strip 34 are also in one preferred embodiment protected by a layer of laminate 68. The laminate 68 is again in one embodiment a layer polyester of approximately 1.5 mils thickness. The polyester layer protects the silk-screen layers 64 and 66 from scratching, tearing and moisture.

Figure 4:
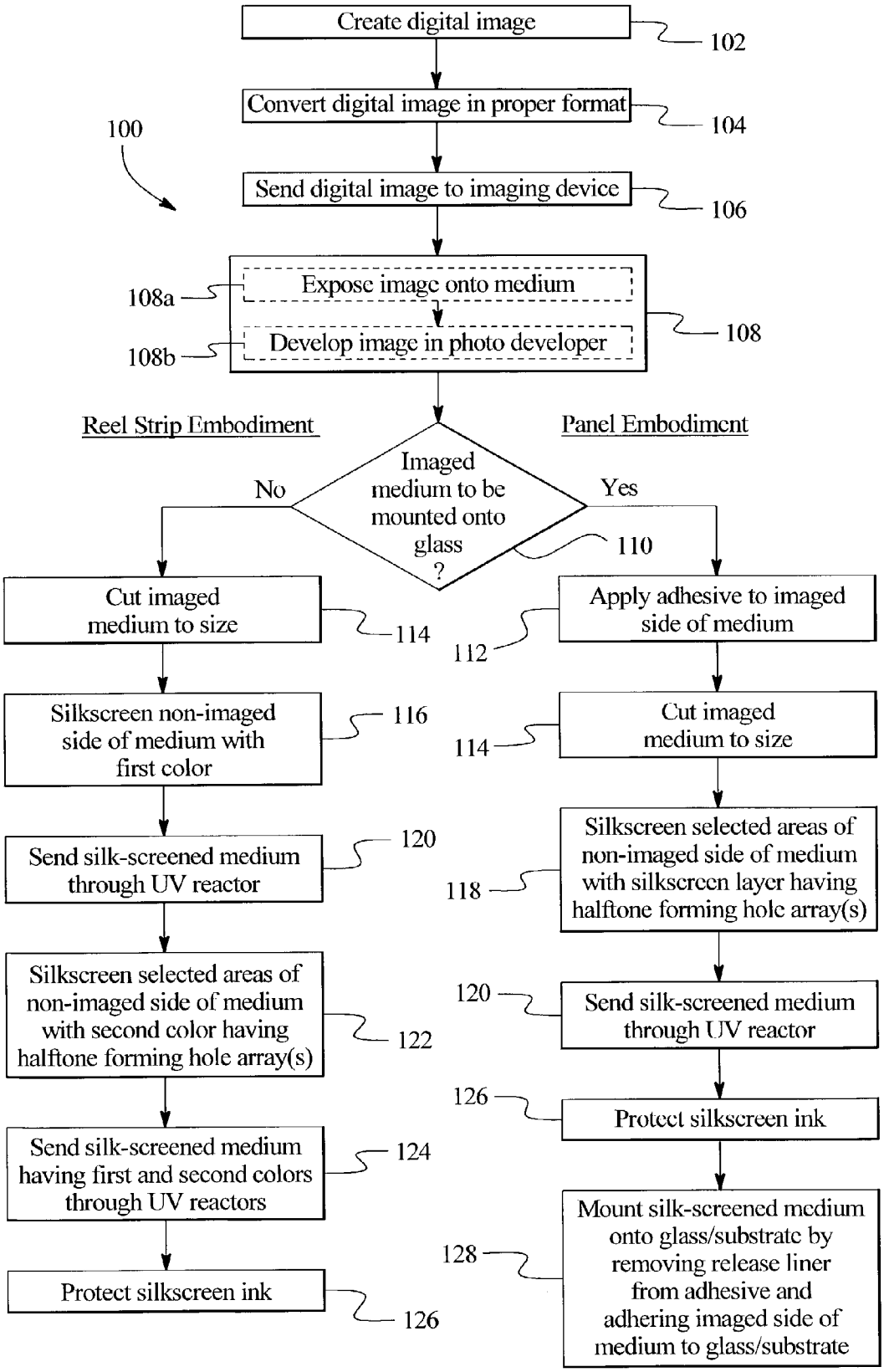
FIG. 4 is a schematic process flow diagram illustrating one embodiment of a method of making a display of the present invention.

Referring now to FIG. 4, one embodiment of a method 100 for producing a display of the present invention is illustrated. The method 100 describes embodiments for producing either a panel or a reel strip. The first step is to create a file for the digital image, as indicated by block 102. Typically, a designer draws and/or renders the digital image on a computer screen using illustration software. The present invention includes any type of illustration software, image enhancement system, as well as PC and Macintosh™ files. In one preferred embodiment of the present invention, the designers use the Adobe Illustrator™ software program.

The next step is to take the digital image in the format created by the designer and to convert that format to the proper format for sending the file to the imaging device, as indicated by block 104. In one embodiment, the drawing file is converted to an encapsulated post script ("EPS"). The file is sent to a RIP Server that uses a specialized software, for example Cheetah™ software manufactured by Durst Dice America™, which converts or "rips" the file from the EPS format to a portable pixel map ("PPM"), which is the form used by the Durst Lambda™ printer. Depending upon the imaging device, the format of the digital file may or may not need to be changed or converted. For example, if the digital image is created using a drawing package that outputs a .dwg file, the drawing may be sent directly to a printer or plotter that produces the digital image without having to convert the file.

The designer then sends the digital image to the imaging device, as indicated by block 106. The digital imaging device can be any suitable device known to those of skill in the art that produces a digital color image on a transparent or translucent film. The imaging device therefore includes laser printers, ink jet printers, plotters, scanners, dry film printers, drum-type printers or any other device capable of producing a multicolored image on a transparent or translucent substrate.

In one preferred embodiment, the digital imaging device includes a Durst Lambda™ 130 photographic imager. The Durst Lambda™ 130 imager outputs media up to 50 inches (127 cm) wide. The Durst Lambda™ 130 imager is a direct digital photographic printer that exposes a digital image directly from a computer file without the need for a negative or transparency. The Durst Lambda™ prints onto the emulsion layers 42*b* and 58*b* described above in connection with FIGS. 2 and 3, which include photographic silver-halide materials (color negative materials).

The photographic imager in an embodiment uses lasers including red, green and blue lasers to form a single calibrated beam of light to expose the emulsion. The photographic imager can expose up to 200 ft (60 m) of the medium. Digital images having resolutions between 200 and 400 ppi (pixel per inch) may be achieved. Each color pixel is specified by one of 256 distinct levels of red, green and blue information and is imaged as one continuous tone point, achieving approximately 16.7 million possible colors.

As indicated by block 108, the preferred photographic imaging device of the present invention includes two substeps indicated by blocks 108*a* and 108*b*. In the step indicated by block 108*a*, the digital image is sent to the photographic printer. The photographic printer, which is in a preferred embodiment the Durst Lambda™ printer described above, includes a plurality of feed rolls of unexposed medium such as the DURACLEAR™ medium described above in connection with the medium 42 and the medium 58. The printer in an embodiment includes five of such rolls. The rolls are capable of receiving digital images of different sizes, for example, any size up to 50 inches (127 cm).

The panels 38 and 40 in one embodiment are 30 inches (76.2 cm) or 40 inches (101.6 cm) wide. The designer or operator selects one of the turrets or rolls from which to expose the digital image and also a number of digital images to print. The selected feed roll or turret unwinds the necessary medium, and a take-up roll receives the medium after the film has been exposed. The imaging machine cuts the film after the defined number of digital images have been exposed.

In the step indicated by block 108*b*, the take-up roll is removed from the photographic printer and transported to a photographic developer. The imaging device of the preferred embodiment therefore includes the photographic printer and the photographic developer. The process of exposing the image onto the medium with the layer of emulsion and transporting the exposed medium to the photographic developer is done in the dark so as not to prematurely develop the exposed medium, as is well known to those of skill in the art. A suitable photographic developer may be obtained from Colex Imaging Inc., Paramus, N.J. The Colex photographic processor is used to perform the RA-4 process. The photographic developer accepts the roll of exposed medium, unrolls the roll and develops the exposed image via the RA-4 process. The digital image then appears as a positive set of colors on the transparent material and is no longer light sensitive.

If the imaged medium is eventually displayed on a panel 38 or 40, the imaged medium is mounted to a substrate or glass, as indicated by diamond 110. If the imaged medium is eventually displayed on a reel strip 34, the imaged medium is not mounted to a substrate or glass as also indicated by diamond 110.

When the imaged medium is to be mounted on a reel strip, the next step is to cut the imaged medium to the proper reel strip size, as indicated by block 114. Next, an operator silk-screens the non-imaged side of the imaged medium with a first color, as indicated by block 116. As described above, the first layer of silk-screened ink is preferably white and covers all of or most of the non-imaged side of the medium.

The operator then sends the medium having the first silk-screen layer of ink through a UV reactor, as indicated by block 120. The UV reactor cures the first layer of silk-screened ink as is well known. The operator then silk-screens selected areas of the non-imaged side of the medium with a second color, which has one or more halftone forming hole arrays as indicated by block 122. As described above, the second layer of silk-screened ink is preferably light absorbing and most preferably black but includes one or more halftone hole arrays. The array(s) enable the underlying white ink and the digital image to be translucent in contrast to the rest of the strip which is at least substantially opaque. The imaged medium then passes through the UV reactor another time with the second layer of silk-screened ink to cure the second layer, as indicated by block 124.

It should be appreciated that any suitable number of layers of silk-screened ink may be applied to the non-imaged side of the medium, however, one of the advantages of the present invention is that the normal process of silk-screening is greatly simplified. First, only two layers of silk-screened ink are applied. Second, the first layer is applied to all or substantially all of the digitally imaged medium, so that the silk-screen needed is a simple flood plate. Also, the first layer is made without having to precisely register the medium in any particular position. Further, FIG. 3 illustrates that the second layer of silk-screened ink 66 is also relatively simple and serves to provide translucent highlighting to certain symbols on the reel strip, such as scatter symbols, wild symbols or symbols that provide or help provide a large payout to the player.

The reel strip, with the multiple layers of silk-screened ink and the digitized image, receives a protective coating to protect the silk-screened ink, as indicated by block 126. As described above, the protective coating in one preferred embodiment is a 1.5 mil layer of polyester. In other embodiments, any suitable type of clear protective film or plastic may be used.

Referring now to the panel embodiment, after the image is developed onto the medium, an operator applies the preferably double sided adhesive to the imaged side of the medium, as indicated by block 112. The operator cuts the image to the proper size as indicated by block 114. The width of the panel is established by the width of the selected feed roll. The operator then cuts the medium to the proper height. If the medium contains a number of different images, the operator cuts or separates the images.

One of the sides of the medium receives a layer of silk-screened ink, which defines one or more halftone hole arrays, as indicated by block 118. Typically, the non-imaged side of the medium receives silk-screened ink, however, it is possible through reverse printing to place silk-screened ink on the imaged side of the medium. In the panel 38 or 40, as described above, the silk-screen blocks the ink from adhering to certain areas that the designer wishes to have enhanced backlighting, e.g., to appear to glow or to appear almost as neon. These areas in one preferred embodiment are relatively small and are limited to words or special symbols. The layer of silk-screened ink in an embodiment is white, which lets some backlight through the panel, but also enables outside light to reflect and produce a rich and bright image on the front of the glass.

The operator in an embodiment applies only a single white silk-screen layer, which makes certain areas of the transparent medium translucent. In alternative embodiments, the operator may apply multiple layers of silk-screened ink that overlap each other or reside in registry with one another. A polymer based protective coating is applied to the one or more layers of silk-screened ink, as indicated by block 126. The protective coating protects the silk-screen ink as described above.

The imaged medium, with one or more layers of silk-screened ink and a layer of adhesive, mounts to a desired substrate, as indicated by block 128. In one preferred embodiment the double sided adhesive includes a release liner that the operator removes to mount the medium to the substrate, such as glass. The release liner resides on the outside of the adhesive layer, so that the operator can readily remove the release liner to adhere the medium to the substrate.

Figure 5:
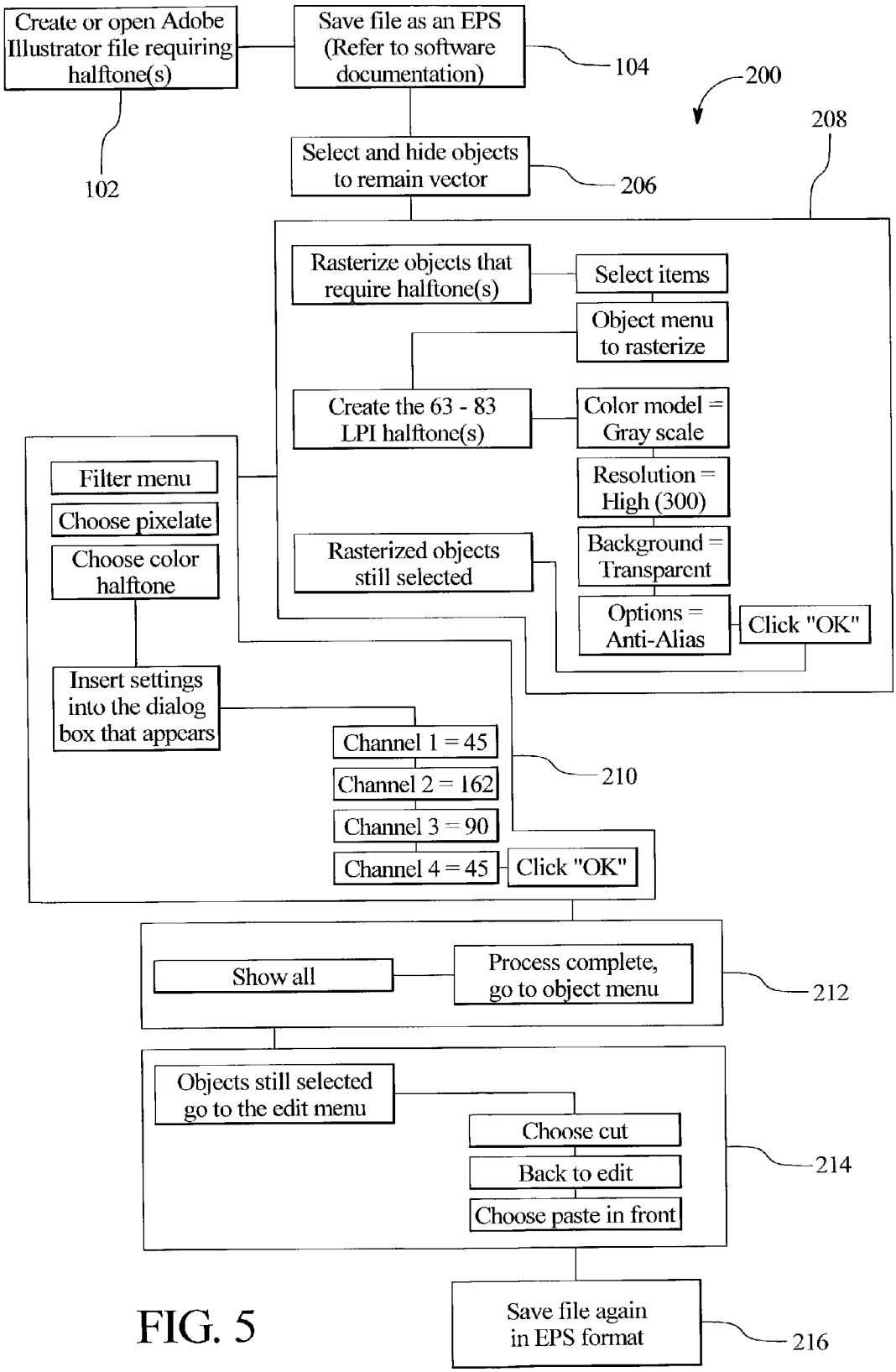
FIG. 5 is a schematic process flow diagram illustrating one embodiment of a method of producing the halftones of the present invention.

Referring now to FIG. 5, a method 200 for producing the halftones of the present invention is illustrated. Method 200 is performed during the steps indicated by blocks 118 and 122 of the method 100 illustrated in FIG. 4. For reference, method 200 is shown having the same first two steps of method 100, namely, the steps indicated by blocks 102 and 104. In step 102, the designer opens an existing file or creates a new file having the artwork requiring the use of simulated dots. In an embodiment, the Adobe Illustrator™ 8 (or newer) software program is used. The file is converted and saved as an EPS file in step 104. As stated above, the EPS file is sent to the RIP Server, which "rips" the file into the PPM format for the Durst Lambda™ imager.

The designer is now at the stage to produce a positive or negative image of a white plate using a digital photo imager, such as the Durst Lambda™ photo imager. An example of a positive image is illustrated and discussed below in connection with FIG. 6. It is important to note that this white plate is in addition to the multicolored medium developed in method 100 in steps 108*a* and 108*b*. The white plate is not actually made part of the resulting display in one preferred embodiment. The white plate is used instead to make a screen for screen-printing a white, silver or other colored or multicolored layer of UV curable ink on the side of the multicolored medium opposing the side with the photo developed image.

To make the white plate (whether positive or negative), the designer selects each of the elements of the design or artwork that the designer wishes to keep in vector format and hides these elements, as indicated by block 206. In vector format, the elements are described mathematically by radius, magnitude or angle, for example. The alternative to vector format is raster format, which uses rows upon rows of dots, which are either on or off, to create an element of an image. Vector outputs have smooth edges because the printer actually draws the mathematical element. Raster outputs are jagged and dot shaped. Any edges that the designer wishes to have a smooth edge should be stored as vector elements. The designer hides the vector elements so that only the elements having halftones are shown on the computer screen.

Any elements or parts of elements that the designer wishes to have halftones need to be in raster format. Raster format enables the halftone dots to be created. The next step is to apply a filter requiring a rasterized image as indicated by block 208. Various software packages may have different methods of applying such a filter. In the Adobe Illustrator™ software program, an "Objects" drop down box enables the designer to select a "rasterize" feature. Using the rasterize feature, the designer makes a number of settings, namely: (i) a color mode is set to grayscale, which removes color information from the selected elements so that the resulting image varies in shades of black and has no other color; (ii) resolution is set to high, e.g., 300 pixels per inch ("ppi"); (iii) background is set to transparent; and (iv) an Anti-Alias box is selected. These settings enable simulated halftones having varying dot amplitudes and/or dot frequencies between any desired and achievable line per inch requirement. In one embodiment, 63 to 83 lines per inch are generated via the color halftone filter.

Figure 6:
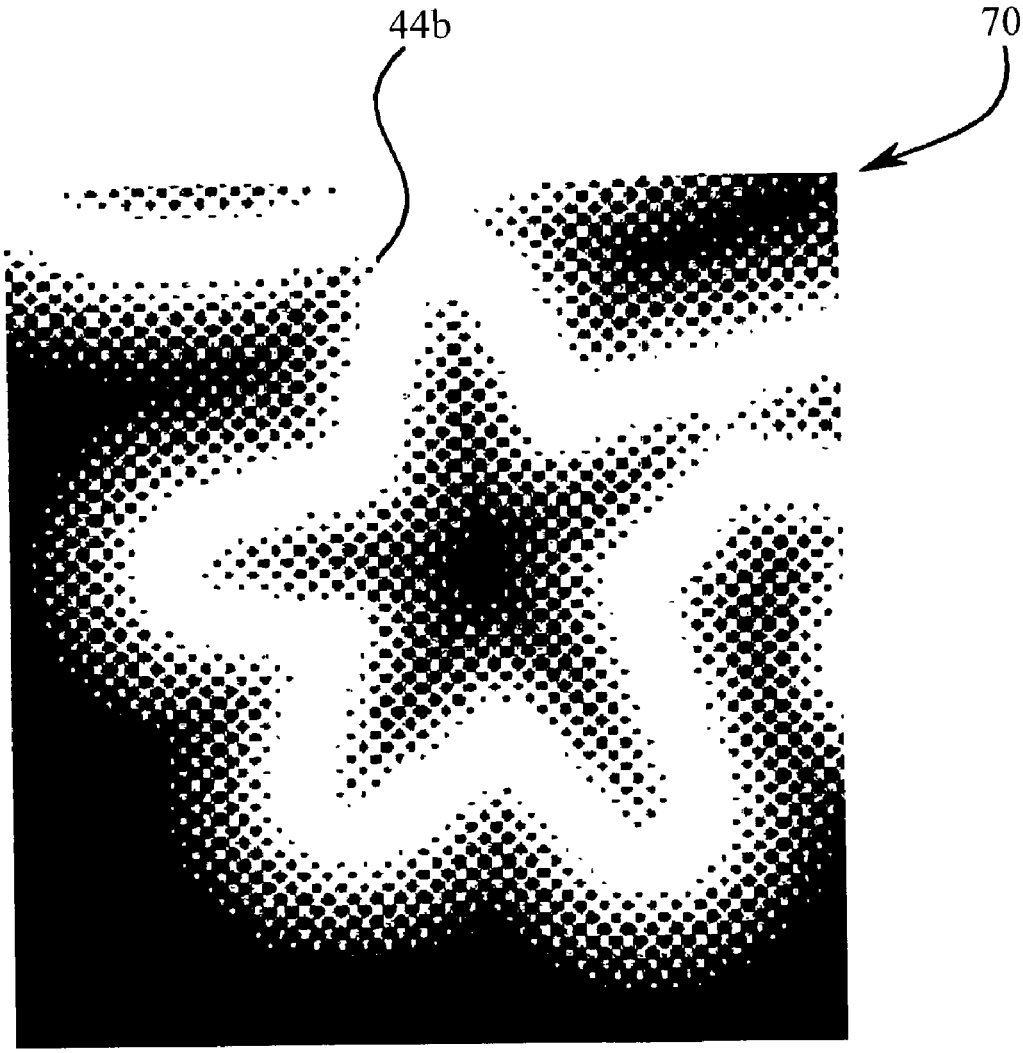
FIG. 6 is an enlarged view of a medium having a digital halftone pattern, which is used to make a silk-screen that produces a desired halftone hole pattern of the present invention.

With the rasterized elements still selected, the designer manipulates a filter pull down menu, as indicated by block 210. In this step, the designer chooses "pixelate", then "color halftone" and inserts, for example, the following settings: (i) maximum radius=five pixels; (ii) channel one=forty-five degrees; (iii) channel two=162 degrees; (iv) channel three=ninety degrees; and (v) channel four=forty five degrees. These settings enable simulated halftone dot arrays to be made along forty-five degree lines, an example of which as illustrated in FIG. 6. These settings represent the default settings in the particular imaging software used and represent merely one example of various possible settings that would work with the present invention.

With the settings made, all previously hidden lines are made to reappear by returning to the objects menu and selecting "show all", as indicated by block 212. The reappearing items are selected, cut to clipboard and then pasted in front of the rasterized elements, as indicated by block 214. The design or artwork with simulated halftones is then saved in EPS format as indicated by block 216.

Referring now to FIG. 6, the EPS file including simulated halftones is sent to and printed out on the photographic imager, such as the Durst Lambda™ photo imager. The photographic imager exposes the image onto a medium, for example, the same medium used for the panels and the reel strip. The photographic developer develops the exposed medium to produce the positive or negative black image of a layer of silk-screen ink. FIG. 6 shows an example of a positive image of the hole array 44*b* of FIG. 2 on the medium 70. The hole array 44*b* produces the halftones in the star shaped outline. Being the positive of the silk-screen, the areas illustrated as black will eventually be the areas through which white, light blocking ink passes. The areas illustrated as white represent transparent areas of the medium 70.

Medium 70 is temporarily adhered to a screen with emulsion (not illustrated) and subjected to ultraviolet radiation. The white (clear) areas of medium register with corresponding areas of the emulsion. These emulsion areas are exposed therefore to ultraviolet light and are not, consequently, removed in the washing process. The unexposed areas of the emulsion are washed off, leaving the screen beneath. When the screen dries or cures, the operator removes any unwanted portions or imperfections from the screen, wherein the screen is then ready for printing.

The bare screen areas allow ink to selectively flow and dry onto the back of the digitally imaged medium (elements 42 and 58 in FIGS. 2 and 3, respectively. To create halftones, an array of white dots of varying size and/or spacing and therefore density flow onto to the back of the imaged medium and selectively block backlight from shining through the imaged medium. The more dots or the larger the dots, the less light. The dots in one preferred embodiment form lines at approximately forty-five degrees but can otherwise form lines at any desired angle or be randomly or stochastically formed. While white dots are one preferred color, the present invention expressly contemplates using dots of one or more different colors, such as silver, or multicolored dots.

A number of alternative embodiments of the present invention are contemplated. In one alternative embodiment, the halftone or white layer can be provided on a medium separate from the medium having the colored, digital image of the design or artwork. Here, the two mediums would be placed in registry and laminated or adhered together to a piece of glass or clear plastic in the case of a panel display. The two mediums could be placed backside to backside or image side to backside. In the first instance, the halftone image on the white medium would be oriented the same as the artwork image on the color medium. In the latter instance, the halftone image on the white medium would be a mirror image of the image on the color medium. In either case, the white medium could be photographically produced, eliminating all screen-printing.

In a further alternative embodiment, it may be possible to obtain, now or in the future, double sided unexposed medium. The medium would a clear-base color transparency material and a layer of unexposed emulsion on either side. Either or both emulsion layers could have a releasable protective layer, which protects one side from being effected, while the other side is being processed. Both sides would be capable of producing an image during one or two RA-4 processes. In this embodiment, the color image is exposed onto one side of the medium, while the halftone or white plate image is exposed onto the opposing side. Again, the white color can be photographically produced, eliminating all screen-printing.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device operated under the control of a processor, said gaming device comprising:

a housing;

at least one game supported by the housing, controlled by the processor, and operable upon a wager by a player;

an input device supported by the housing and in communication with said processor, and which enables the player to make the wager to play said game; and a displayed image supported by the housing, said displayed image including a medium having two opposing sides, a digital image attached to one side of the medium, and a silk-screened layer that includes a halftone producing ink pattern attached to the opposing side of the medium from the digital image.

2. The gaming device of claim 1, wherein the digital image forms a shape and the halftone producing ink pattern is formed around at least a portion of a border of the shape on the opposing side.

3. The gaming device of claim 1, wherein the halftone producing ink pattern includes white ink.

4. The gaming device of claim 1, wherein the halftone producing ink pattern includes an array of non-inked areas that oppose directly at least parts of the digital image.

5. The gaming device of claim 1, wherein the halftone producing ink pattern includes an array of inked dots.

6. The gaming device of claim 1, wherein the halftone producing ink pattern includes an array of inked dots having different dot frequencies.

7. The gaming device of claim 1, wherein the halftone producing ink pattern includes an array of inked dots having different amplitudes.

8. The gaming device of claim 1, wherein the halftone producing ink pattern includes an array of inked dots spaced apart differently.

9. The gaming device of claim 1, wherein the halftone producing ink pattern includes an array of inked dots spaced apart randomly.

10. The gaming device of claim 1, wherein the halftone producing ink pattern includes an array of inked dots forming lines at approximately forty-five degrees.

11. The gaming device of claim 1, wherein the silk-screened layer includes a plurality of halftone producing ink patterns.

12. The gaming device of claim 1, wherein the medium includes a polymeric material and a layer of emulsion.

13. The gaming device of claim 12, wherein the polymeric material is transparent or translucent.

14. The gaming device of claim 1, wherein the silk-screened layer is covered by a protective laminate.

15. The gaming device of claim 1, wherein the digital image is covered by a substrate selected from the group consisting of: glass and clear plastic.

16. The gaming device of claim 1, wherein the silk-screened layer is a first silk-screened layer and which includes a second silk-screened layer, said second silk-screened layer attached to the opposing side of the medium from the digital image and the first silk-screened layer attached to the second silk-screened layer.

17. The gaming device of claim 16, wherein the digital image forms a shape, the second silk-screened layer is disposed behind the shape and the halftone producing ink pattern is formed around at least a portion of the border of the shape.

18. The gaming device of claim 1, wherein the medium is a first medium, the digital image attached to the first medium, and which includes a second medium, the silk-screened layer attached to the second medium, the second medium and the silk-screened layer attached to the opposing side of the first medium from the digital image.

19. The gaming device of claim 1, which includes at least one adhesive layer between the digital image and the medium.

20. The gaming device of claim 1, which includes at least one adhesive layer between the silk-screened layer and the medium.

21. A gaming device comprising:

a housing;

a displayed image supported by the housing, said displayed image including a medium, and a digital image disposed on one side of the medium;

a first silk-screened layer disposed on the opposing side of the medium from the digital image and a second silk-screened layer disposed at least partially on the first silk-screened layer; and said first silk-screened layer including a halftone producing ink pattern disposed between the medium and the second silk-screened layer, wherein the first silk-screened layer makes at least a portion of the medium translucent, and the second silk-screened layer makes at least a portion of the medium substantially opaque.

22. A gaming device operated under the control of a processor, said gaming device comprising:

a housing;

at least one game supported by the housing, controlled by the processor, and operable upon a wager by a player;

an input device supported by the housing and in communication with said processor, and which enables the player to make the wager to play said game;

a displayed image supported by the housing, said displayed image including a medium having two opposing sides and a digital image attached to one side of the medium; and a silk screened layer including a halftone producing ink pattern attached to the opposing side of the medium from the digital image, wherein at least a portion of said silk-screened layer is in registry with at least a portion of said digital image.

23. The gaming device of claim 22, wherein the digital image forms a shape and the halftone producing ink pattern is in registry with at least a portion of a border of the shape.

24. The gaming device of claim 22, wherein the halftone producing ink pattern includes an array of non-inked areas that are in registry with at least a portion of the digital image.

25. The gaming device of claim 22, wherein the halftone producing ink pattern includes an array of inked dots.

26. The gaming device of claim 22, wherein the halftone producing ink pattern includes an array of inked dots having different dot frequencies.

27. The gaming device of claim 22, wherein the halftone producing ink pattern includes an array of inked dots having different amplitudes.

28. The gaming device of claim 22, wherein the halftone producing ink pattern includes and array of inked dots spaced apart differently.

29. The gaming device of claim 22, wherein the halftone producing ink pattern includes an array of inked dots spaced apart randomly.

30. The gaming device of claim 22, wherein the halftone producing ink pattern includes an array of inked dots forming lines at approximately forty-five degrees.

31. The gaming device of claim 22, wherein the silk-screened layer includes a plurality of halftone producing ink patterns.

32. The gaming device of claim 22, wherein the medium includes a polymeric material and a layer of emulsion.

33. The gaming device of claim 32, wherein the polymeric material is transparent or translucent.

34. The gaming device of claim 22, wherein the silk-screened layer is covered by a protective laminate.

35. The gaming device of claim 22, wherein the digital image is covered by a substrate selected from the group consisting of: glass and clear plastic.

36. The gaming device of claim 22, wherein the medium is a first medium, the digital image attached to the first medium, and which includes a second medium, the silk-screened layer attached to the second medium, the second medium and the silk-screened layer attached to the opposing side of the first medium from the digital image.

* * * * *

UNITED STATES PATENT AND TRADEMARK OFFICE

CERTIFICATE OF CORRECTION

PATENT NO. : 6,976,915 B2
DATED : December 20, 2005
INVENTOR(S) : Curtis L. Baker et al.

It is certified that error appears in the above-identified patent and that said Letters Patent is hereby corrected as shown below:

Title page,
Item [75], Inventors, change "Jeffery J. Jo" to -- Jeffrey H. Jo --.

Signed and Sealed this

Eleventh Day of April, 2006

JON W. DUDAS
*Director of the United States Patent and Trademark Office*